US006390615B1

(12) United States Patent
Carrese et al.

(10) Patent No.: US 6,390,615 B1
(45) Date of Patent: May 21, 2002

(54) INK TANK WITH SECURING MEANS AND SEAL

(75) Inventors: Edward M. Carrese; Brian S. Hilton, both of Rochester; Eric A. Merz, Webster; James R. Brown, Sodus; Steven R. Moore, Rochester; Arthur J. Sobon, Rochester; Hiep Nguyen, Rochester; Kenneth W. Altfather, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,635

(22) Filed: Nov. 28, 2000

Related U.S. Application Data

(62) Division of application No. 09/597,544, filed on Jun. 19, 2000.

(51) Int. Cl.[7] ..... B41J 2/175
(52) U.S. Cl. ..... 347/86
(58) Field of Search ..... 347/86, 87

(56) References Cited

U.S. PATENT DOCUMENTS

| | | | | | |
|---|---|---|---|---|---|
| 5,502,479 | A | * | 3/1996 | Ishinaga et al. | 347/87 |
| 5,821,966 | A | * | 10/1998 | Schell et al. | 347/86 |
| 5,828,395 | A | * | 10/1998 | Takata | 347/86 |
| 5,917,525 | A | * | 6/1999 | Butty | 347/86 |
| 5,949,459 | A | | 9/1999 | Gasvoda et al. | |
| 6,074,049 | A | * | 6/2000 | Machler | 347/86 |

* cited by examiner

*Primary Examiner*—Judy Nguyen
(74) *Attorney, Agent, or Firm*—Oliff & Berridge, PLC.

(57) ABSTRACT

An ink tank and ink tank support structure which contains structural elements which are designed to permit proper installation of the ink in the ink tank support structure while minimizing the chances of improper installation of the ink tank in the ink tank structure. A primary ink tank seal is provided in the ink tank, and a relatively low compressive force seal is provided between the ink tank support structure and the ink tank to reduce leakage of fluid from tank and limit evaporation of fluid from the tank despite repeated insertions and removals of the ink tank from the ink tank support structure. A variable capacity ink tank and an ink tank with staggered height walls are disclosed, as well as a code reader for determining characteristics of ink tanks.

9 Claims, 17 Drawing Sheets

FIG. 1
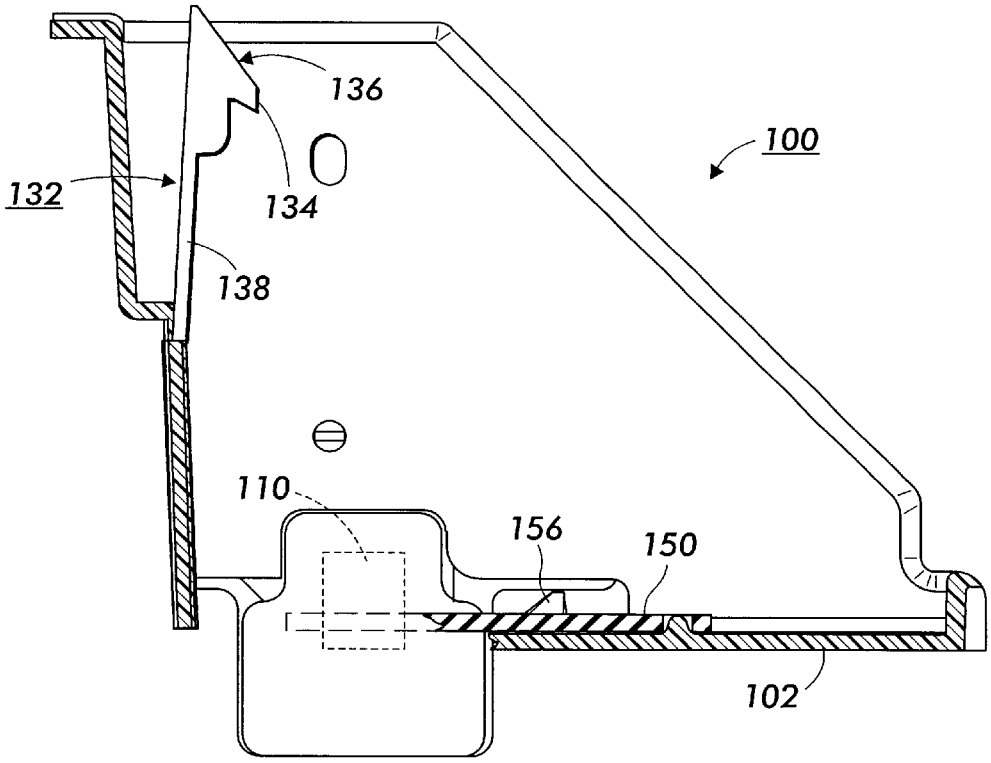
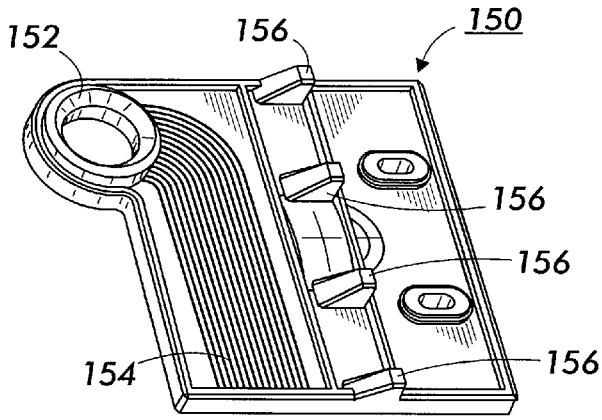
FIG. 2

INK TANK WITH SECURING MEANS AND SEAL

This is a Division of Application Ser. No. 09/597,544 filed Jun. 19, 2000. The entire disclosure of the prior application is hereby incorporated by reference herein in its entirety.

BACKGROUND OF THE INVENTION

1. Field of Invention

This invention relates to print head ink tanks and ink tank support structures.

2. Description of Related Art

This invention is related to co-pending application, Ser. No. 09/382,886, filed Aug. 25, 1999, and to Ser. No. 08/664,581, now U.S. Pat. No. 5,821,966, issued Oct. 13, 1998, incorporated by reference in their entirety.

Print heads may be formed as an integral part of an ink tank or cartridge, or they may be formed as part of a print head ink tank support structure into which one or more individual ink tanks or cartridges may fit. Print heads which are part of an ink tank support structure into which separate ink tanks are positioned need a number of features for proper operation. These features include mechanisms for ink tank insertion, retention and removal from the ink tank support structure, and for sealing the ink tank(s) to the ink tank support structure to reduce ink evaporation and leakage.

SUMMARY OF THE INVENTION

This invention is directed to a print head formed as part of an ink tank support structure and a corresponding ink tank that have elements that significantly minimize any instances of improper insertion of an ink tank into the ink tank support structure, and retain an ink tank in a proper position in an ink tank support structure even if the ink tank and ink tank support structure are mishandled, e.g., by being dropped, or rapidly accelerated, e.g., in a carriage mechanism used to move a print head relative to a medium to which ink is to be applied, and that forcibly retain the ink tank in a position to achieve proper operation of the print head and related devices, such as, for example, ink level detectors, and/or provide a seal between the ink tank and the ink tank support structure that reduces ink evaporation and spillage of ink from the tank during insertion of the ink tank into, retention of the ink tank in, and removal of the ink tank from, the ink tank support structure.

Ink tank support structures according to this invention may include a manifold element into which a number of ink lines are fed and which, in turn, feeds the print head elements. An ink tank support structure may also include elements to assist proper insertion into and removal of an ink tank from the ink tank support structure. An ink tank support structure according to this invention can provide seals to reduce ink from leaking from replaceable ink tanks, and to reduce evaporation of ink from the ink tank while the ink tank is positioned in the ink tank support structure, despite multiple insertions and removals of the ink tank from the ink tank support structure.

The ink tanks and ink tank support structures of this invention contain some or all of these features. In various exemplary embodiments, the ink tanks and ink tank support structures of the current invention use one or more resilient elements, located separately and apart from the fluid path of the print head and ink tank, including the seal between the ink tank and the ink tank support structure, to assist in removing the ink tank from the ink tank support structure. By locating the resilient elements away from the fluid/ink path, the assist force is applied to the ink tank structure instead of being applied to the fluid path and its elements.

In various exemplary embodiments, the resilient elements are springs or elastomeric springs. In addition, the ink tank removal assist elements can also bias the ink tank against part of the ink tank support structure to help retain the ink tank in the proper position when the ink tank has been properly positioned or seated in the ink tank support structure. Also, the seal element, which is made of a resilient material, can bias the ink tank against part of the ink tank support structure to help retain the ink tank in the proper position when the ink tank has been properly positioned or seated in the ink tank support structure.

In other exemplary embodiments, the ink tank seal support component is provided with a relatively large surface area having capillary ribs or channels to wick away any fluid which may leak from the ink tank.

In other exemplary embodiments, the ink tank has a low compression force seal which forms a secondary seal around a manifold pipe on which the ink tank is mounted, i.e., around its fluid path port.

In other exemplary embodiments, a primary ink tank seal, also called a port wiper seal, which may be formed integrally with an ink tank cover, is used to provide both a vapor seal and a liquid seal to prevent leakage of ink liquid and vapor from the ink tank. The port wiper seal surrounds the manifold mounting pipe.

In other exemplary embodiments, the manifold mounting pipe has a tapered end which is inserted into the ink tank to form a compression fit with the primary ink tank seal.

In other exemplary embodiments, the ink tank support structure and the ink tank are provided with a securing system that securely retains the ink tank in the ink tank support structure in a proper orientation and position. The securing system is constructed to reduce the ability of a user to install the ink tank into the ink tank support structure in an improper orientation or position. The securing system also permits accurate location of ink tank ink parameter observation or display elements relative to corresponding ink tank parameter detection elements located on or separate from the ink tank support structure, to enable a user of the print head to determine the status of various operational parameters, including, for example, tank presence, proper fluid flow, amount of fluid in an ink tank, and proper installation of the ink tank in the ink tank support structure.

In other exemplary embodiments, the ink tanks are provided with indicia which are read by a code reader to determine various characteristics of the ink tanks, including the manufacturer or brand of ink tank, and ink tank contents, including type of ink, such as, for example, pigmented ink or dye based ink.

In other exemplary embodiments, the ink tank support structure or components of the ink tank support structure, such as, for example, ink tank latch mechanisms, may be an integral part of a carriage on which the ink tanks are moved in operation of a printer.

These and other features and advantages of this invention are described in or are apparent from the following detailed description of various exemplary embodiments of the systems and methods according to this invention.

BRIEF DESCRIPTION OF THE DRAWINGS

FIG. 1 is a side view of a first exemplary embodiment of an ink tank support structure according to this invention;

FIG. 2 is a perspective view of one exemplary embodiment of a removable bottom portion usable in the ink tank support structure of FIG. 1;

DETAILED DESCRIPTION OF EXEMPLARY EMBODIMENTS

Figure 3:
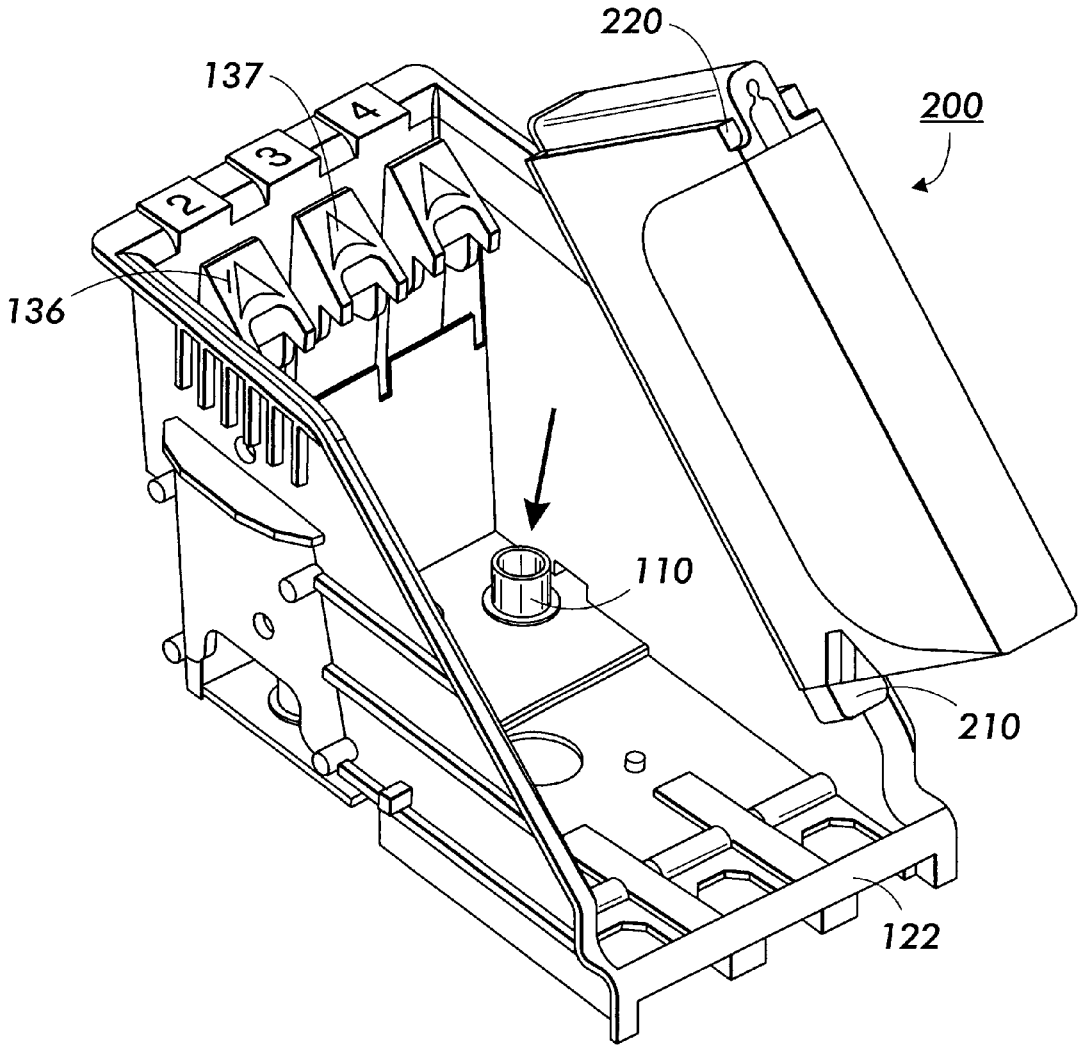
FIG. 3 is perspective view of the first exemplary embodiment of the ink tank support structure and an ink tank according to this invention prior to installation.
Figure 21:
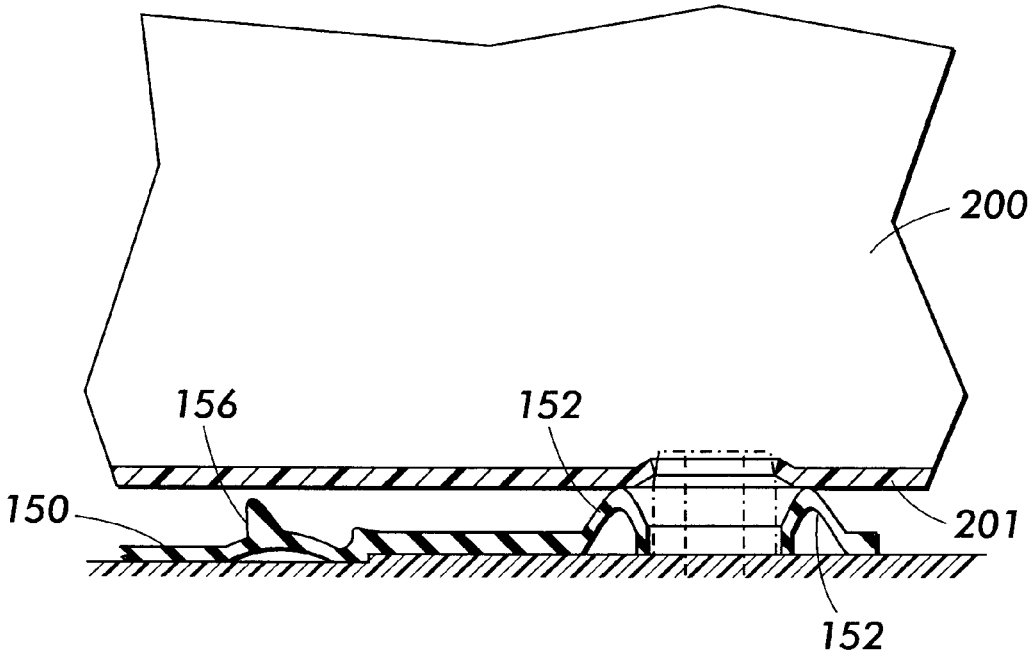
FIG. 21 is a side view of the removable bottom portion of FIG. 2 and the ink tank inserted in a proper position in the ink tank support structure.

FIGS. 1–3 illustrate a first exemplary embodiment of an ink tank support structure 100 according to this invention. The ink tank support structure 100 has a first surface 102 onto which is placed or formed an integral seal and ejection mat 150. As shown in FIG. 2, in one exemplary embodiment, the integral seal and ejection mat 150 contains a number of capillary channels 154 and a relatively low compression force seal 152. "relatively low" force is low relative to the force provided to assist removal of an ink tank 200, as shown in FIG. 3, from the ink tank support structure 100 by one or more resilient elements 156. Illustratively, a typical force used to assist removal of the ink tank 200 from the ink tank support structure 100 according to this invention may be from 5 to 6 pounds. A relatively low compression force with respect to an assist force of that magnitude would be relatively lower, such as, for example, in a range of 2 pounds or less. A detailed cross-sectional view of the low compression force seal 152 is shown in FIG. 21. The integral seal and ejection mat 150 also has a textured or matte surface that comes into contact with the ink tank support structure 100 on which the integral seal and ejection mat is located. This provides a mechanical means to hold the seal in place. The low compression force seal 152 is designed to buckle when it comes in contact with the ink tank to ensure high surface area contact with the ink tank throughout a wide range of deflections of the ink tank.

The capillary channels 154 are used to provide evaporation paths for ink from the ink tank 200. These evaporation paths may be used alone or in combination with other evaporation element(s) to evaporate the volatile liquid portion of any ink that has leaked from the ink tank 200. The one or more resilient elements 156, such as, for example, a spring, is located in a portion of the integral seal and ejection mat 150 that is separate and apart from the compression seal 152. The ink tank support structure 100 also includes a latch mechanism 132. In various exemplary embodiments, the resilient element 156 biases the ink tank 200 against the latch mechanism 132. The resilient element 156 also provides the assist force to urge the ink tank upward against the latch mechanism 132 and, when the latch mechanism 132 is released, to urge the ink tank 200 out of its operational position in the ink tank support structure 100.

A manifold mounting pipe 110 extends through the first surface 102 of the ink tank support structure 100. The mounting pipe 110 forms a conduit through which ink is fed from the ink tank 200 to a print head. In various exemplary embodiments, the print head is provided on the ink tank support structure 100. The integral seal and ejection mat 150, on which the low compression force seal 152 is located, extends around the manifold mounting pipe 110. This low compression force portion 152 of the integral seal and ejection mat 150 forms a secondary seal between the manifold mount tube 110 and the ink tank 200.

Figure 4:
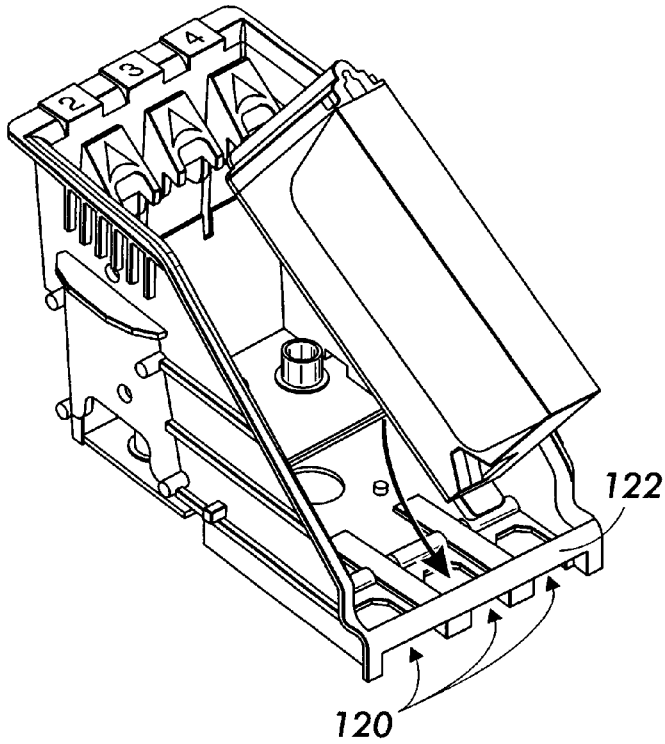
FIG. 4 is a perspective view of the ink tank support structure and the ink tank of FIG. 3 just prior to installation.
Figure 5:
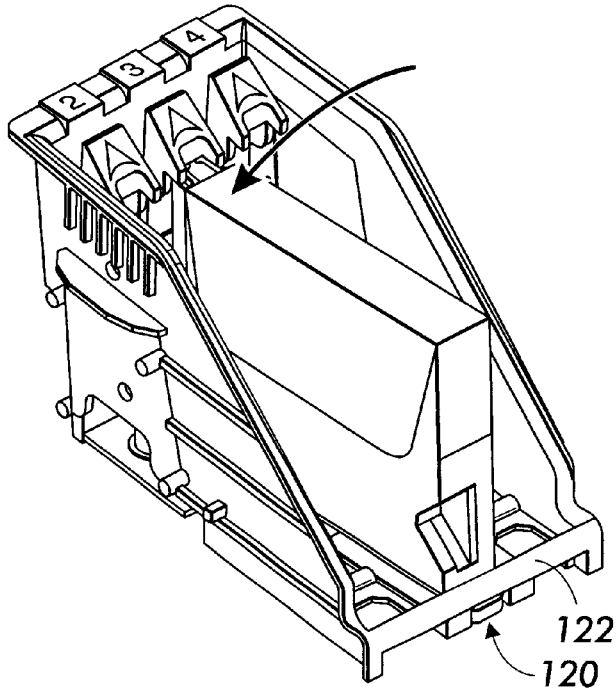
FIG. 5 is a perspective view of the ink tank support structure and the ink tank of FIG. 3 after installation.
Figure 6:
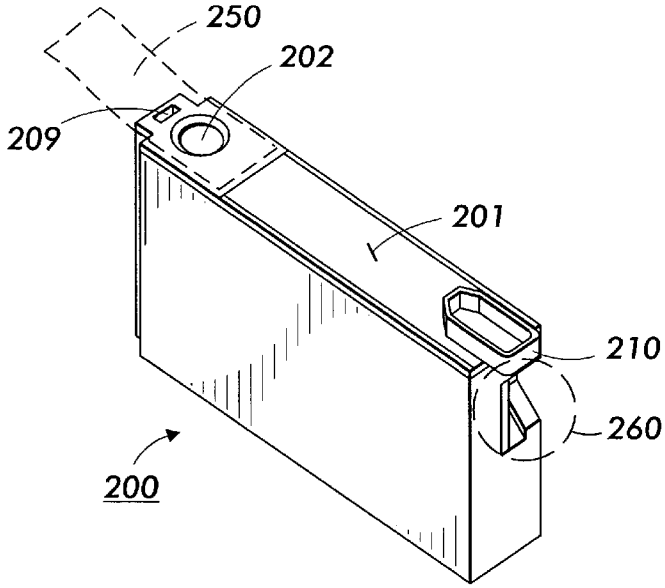
FIG. 6 is a perspective view of one exemplary embodiment of an ink supply aperture and vent aperture and locator foot element according to this invention incorporated into the ink tank of FIG. 3.
Figure 7:
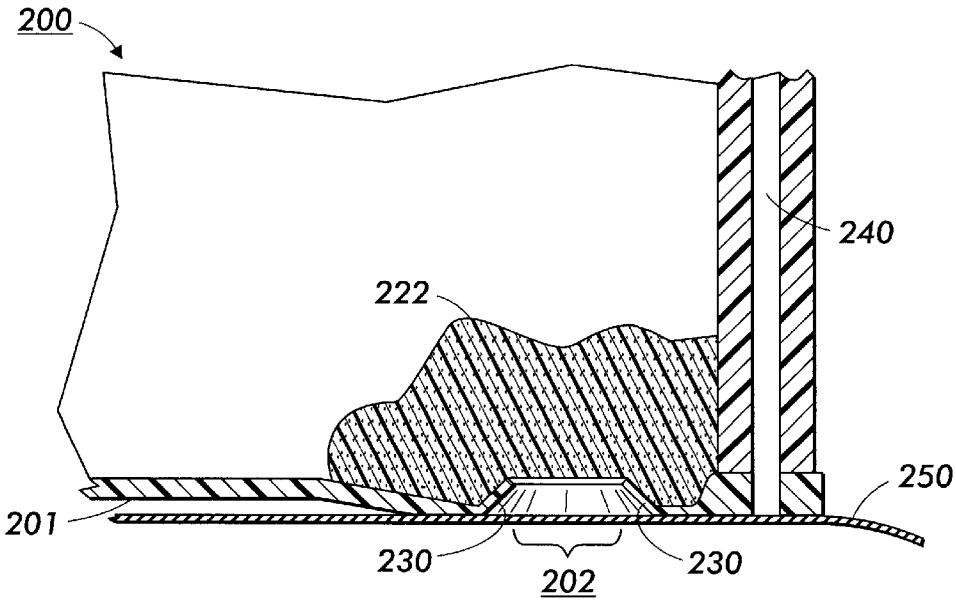
FIG. 7 is a cross-sectional view of one exemplary embodiment of an ink supply aperture and port wiper seal according to this invention incorporated into the ink tank of FIG. 3, FIG. 6 and/or FIG. 18.
Figure 29:
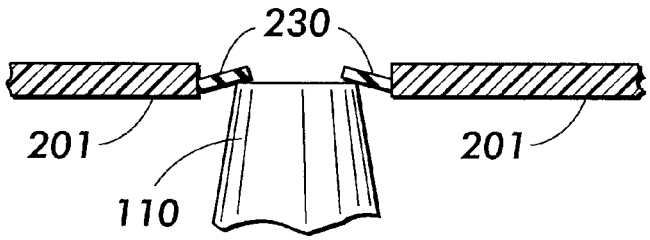
FIG. 29 is a schematic view of a manifold mounting pipe prior to insertion into a ink tank through a primary seal.
Figure 30:
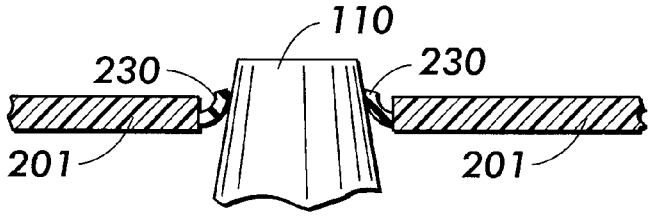
FIG. 30 is a schematic view of a manifold mounting pipe after insertion into an ink tank through a primary seal.

As shown at least in FIGS. 3–5,the manifold mounting pipe 110 is aligned to fit through the seal 152 into an ink tank port hole 202, shown in FIGS. 6 and 7, located in the bottom of the ink tank 200 when the ink tank 200 is properly positioned in the ink tank structure 100. The manifold mounting pipe 110 allows fluid to be withdrawn fluid from the ink tank 200. The manifold mounting pipe 110 may also be tapered, as shown schematically in FIGS. 29 and 30. The taper is typically between 1 degree and 10 degrees from the vertical axis of the manifold mounting pipe 110. This taper allows a snug compression fit between the manifold mounting pipe 110 and primary seal 230, resulting in a seal that is an effective vapor barrier as well as an effective liquid barrier. In FIG. 29, the tapered manifold mounting pipe 110 is shown just prior to insertion into ink tank 200 through ink tank cover 201 and primary seal 230. In FIG. 30, the tapered manifold mounting pipe 110 is shown after insertion into ink tank 200 through ink tank cover 201 and primary seal 230. As shown in FIG. 7, the primary seal 230 may be integrally formed in the ink tank cover 201 as a lip surrounding the port hole 202.

Figure 22:
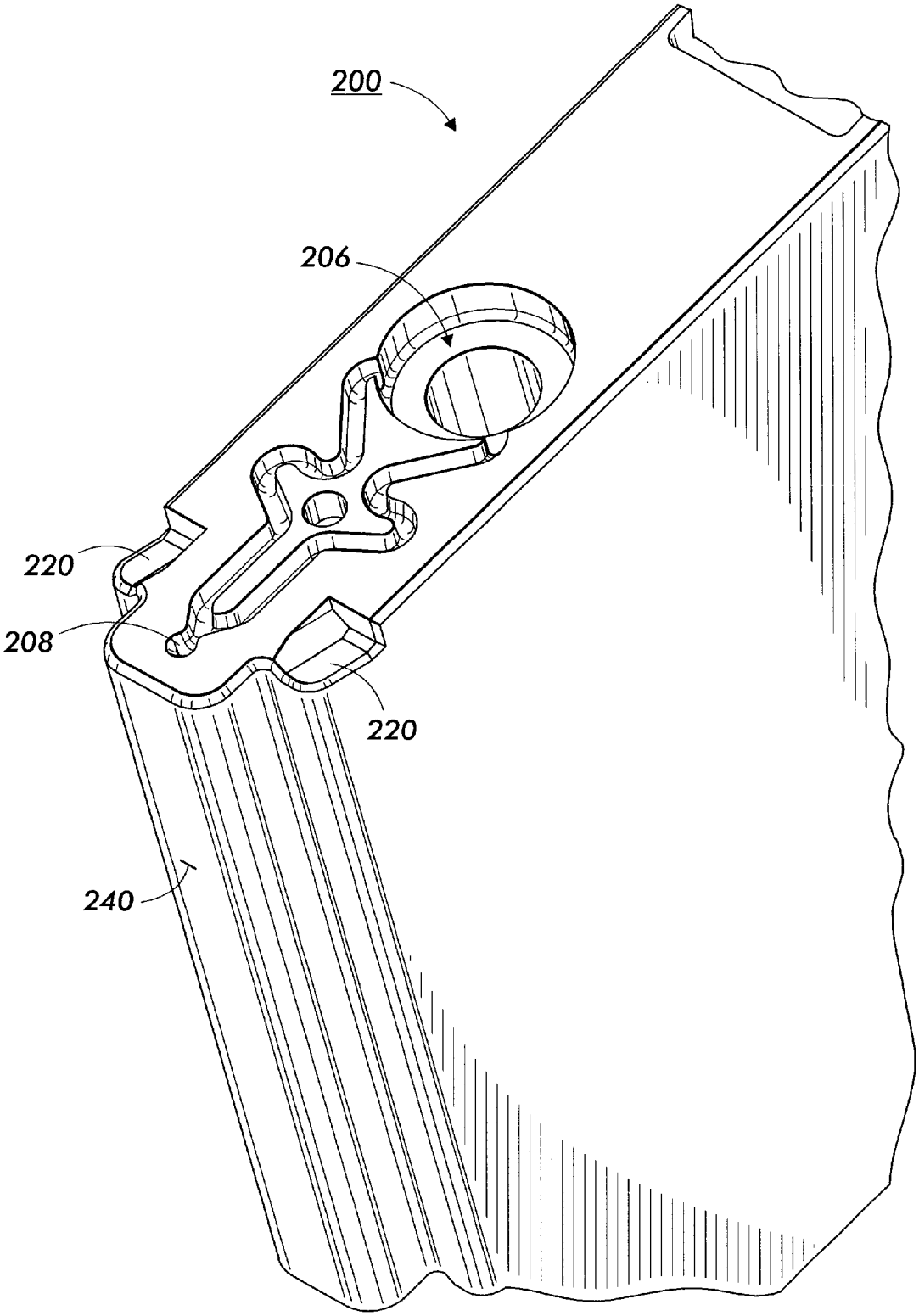
FIG. 22 is a perspective view of one exemplary embodiment of an ink fill aperture and a vent aperture structure and ink tank securing element according to this invention.

FIG. 3 shows the first exemplary embodiment of the ink tank support structure and ink tank structure 100 in greater detail. The ink tank 200 has a generally rectangular shape with positioning and retention features comprising indentations or ridges. The ink tank 200 has one or more latch ramps 220 formed at one end of the ink tank 200. These latch ramps are chamfered. They are inclined surfaces formed by cutting off an edge or corner of an ink tank 200 as shown in FIG. 22, for example. The ink tank also has an ink tank extension locator foot 210. In various exemplary embodiments, the ink tank extension locator foot 210 is located diagonally opposite the end of the ink tank 200 from the one or more of the latch ramps 220.

Figure 8:
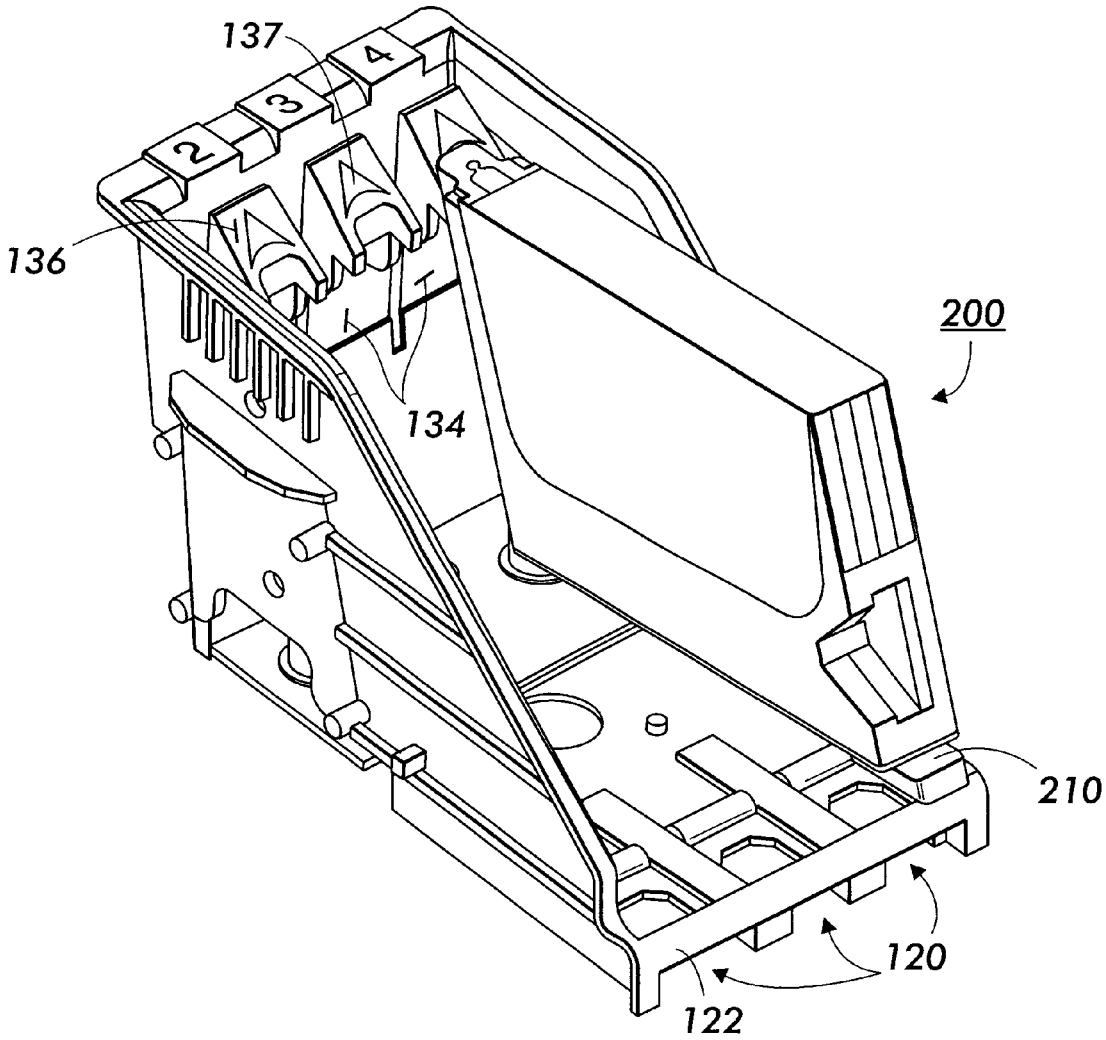
FIG. 8 is a perspective view of the ink tank of FIG. 3 improperly inserted into the ink tank support structure of FIG. 3.

As indicated above, the ink tank support structure 100 contains a latch mechanism 132 that corresponds to and engages with the latch ramps 220 to retain the ink tank 200 in a proper position in the ink tank support structure 100. The latch mechanism 132 may take any suitable form. In various exemplary embodiments, as shown in FIGS. 1 and 3, the latch mechanism 132 includes a latch lever 138. A push-button retainer/release portion 136 is formed at one end of the latch lever 138, while the other end of the latch lever 138 is attached to, or integrally formed as part of, the ink tank support structure 100. The latch mechanism 132 provides a snap fit with the one or more latch ramps 220 on the ink tank 220. The latch mechanism 132 has a retainer portion 134 in the form of protruding members that fit over the ink tank latch ramps 220. The retaining release surface 136 has one or more indicia 137. As shown in FIG. 8, the indicia 137 can be an arrow. The latch mechanism 132 is resilient and moves toward and away from an ink tank because of its own resiliency and in response to having force applied to it, for example, by an ink tank 200 being inserted into the ink tank support structure 100 or by a user's finger or an object held by a user being pressed against the latch mechanism 132, for example, while disengaging the latch mechanism 132 from an ink tank 200.

The ink tank extension locator foot 210 is configured to extend into and through a clearance slot 120 formed at the bottom of the ink tank support structure 100. The ink tank clearance slot 120 is defined by the first surface 102 of the ink tank support structure 100 and a retainer bar 122 located along one end of the first surface 102 of the ink tank support structure 100. The size and the shape of the ink tank extension locator foot 210 are shown in detail in FIG. 6 and are such that the ink tank 200 will fit and latch in its proper position only when the ink tank extension locator foot 210 extends through a corresponding clearance slot 120, as shown in FIGS. 5, 8–12 and 16. Other sizes and shapes of the ink tank extension locator foot 210 may be used as long as the ink tank extension locator foot 210 cooperates with the clearance slot 120 and the retainer bar 122 to substantially reduce the chance of improperly inserting the ink tank 200 into the ink tank support structure 100 and to properly position the ink tank 200 in the ink tank support structure 100. If an ink tank extension locator foot 210 is not fit into its corresponding clearance slot 120, the ink tank 200 is prevented from being rocked or pivoted into its proper position in the ink tank structure 100. This situation is illustrated in FIG. 8. As an additional indication that an ink tank 200 is improperly inserted, the ink tank 200 and the extension locator foot 210 may be given one or more specific, arbitrarily chosen colors, to be more readily observable.

It should be appreciated that the ink tank extension locator foot 210 and the one or more latch ramps 220 can be located anywhere on the ink tank 200, so long as the various functions associated with the ink tank extension locator foot 210 and the latch ramps 220 discussed herein are obtained. It should also be appreciated that, similarly, the latch mechanism 132 can be located on any portion of the ink tank support structure 100 so long as the latch mechanism 132 is able to engage one or more of the latch ramp(s) 220 at their appropriate location on the ink tank 200.

The ink tank extension locator foot 210 and its corresponding clearance slot 120 may have the same color, for example, to help insure that the foot 210 is placed into the proper ink tank extension locator clearance slot 120. Colored indicia may be placed on other portions of the ink tank support structure 100, for example, to help a user put an appropriate ink tank into the correct location in the ink tank support structure 100. In the first exemplary embodiment of the ink tank support structure 100 shown in FIGS. 1 and 3–5, the ink tank support structure 100 is designed to hold three separate ink tanks 200, such as, for example cyan, magenta and yellow ink-containing ink tanks 200. For example, in this exemplary embodiment of the ink tank support structure 100, for each ink tank 200, the color of that ink tank or that ink tank's extension locator foot 210 is the same color as one of the three clearance slots 120. Additional color coding of each ink tank 200 may be used to facilitate placing the appropriate color ink tank in its appropriate position in the ink tank support structure 100. It should also be noted that not all ink tanks in a multiple ink tank embodiment need to contain different color inks, and may include an achromatic ink, such as black ink. The retainer bar 122 retains the extension locator foot 210 while the extension locator foot 210 is being inserted and when the extension locator foot 210 is finally inserted into the ink tank support structure 100.

FIG. 6 shows several features of the ink tank 200, including a removable seal 250 located on a first surface or cover 201 of the ink tank 200. The removable seal 250 is designed to be removed from the surface or cover 201 prior to inserting the ink tank 200 into the ink tank support 100. A bottom vent hole 209 of an ink tank 200 and the ink tank aperture or port hole 202 are located beneath the removable seal 250. The ink tank aperture or port hole 202 receives the manifold pipe 110, which connects through the ink tank support structure 100 to the ink tank 200, when the ink tank 200 is properly positioned in the ink tank support 100. The bottom vent hole 209 and the ink tank aperture or port hole 202 may be of any suitable shape, depth and size.

FIG. 6 also shows structural details of one exemplary embodiment of the ink tank extension locator foot 210, and one exemplary embodiment of an ink level indicator viewing element 260. To obtain information about the level or amount of ink remaining in the ink tank 200, the ink level viewing element 260 is formed in one end of the ink tank 200. When properly positioned in the ink tank structure 100, the viewing element 260 of ink tank 200 is located to be detected by appropriate instrumentation to ascertain the level of ink or other parameter(s) of ink tank 200. As shown in FIG. 7, a primary ink tank seal 230 is used to provide a primary seal between the manifold mounting pipe 110 and the ink tank 200. The primary ink tank seal 230 may, be, in one exemplary embodiment, made of the same semi-rigid plastic, e.g., polypropylene, as a first surface or face of cover 201 of the ink tank 200. As shown in FIG. 7, the primary ink tank seal 230 may be formed as an extension lip of the cover 201, having an annular form about the ink tank port hole 202 of the ink tank 200. This primary ink tank seal 230 in the form of an extension lip may be molded in the tank cover 201 as an extra bit or piece of flash of the cover material. The primary ink tank seal 230 is configured to fit snugly around the manifold mounting pipe 110. The shape and size of the primary ink tank seal 15 may vary depending on the shape and size of the ink tank aperture or port hole 202 and/or the manifold pipe 110. FIG. 7 also shows foam 222 located inside of the ink tank 200.

FIG. 8 shows an improper attempt at installing the ink tank 200 into the ink tank support structure 100. In particular, in FIG. 8, the ink tank extension locator foot 210 is not inserted in the corresponding clearance slot 120. The ink tank extension locator foot 210 is also resting on top of retainer bar 122, instead of below the retainer bar 122. In this position, the ink tank latch ramps 220 are not urged against the ink tank support member latch mechanism 132. The shape and dimensions of the ink tank 200, the latch mechanism 132 and the ink tank support structure 100, including the clearance slots 120 and the retainer bar 122 are chosen to prevent the ink tank 200 from being retained in the ink tank support structure 100 unless extension locator foot 210 of the ink tank is correctly inserted into the clearance slot 120 under the retainer bar 122 and pivoted into position so that the ink tank 200 is inserted and latched as shown in the FIGS. 5, 9–12 and 19.

Figure 9:
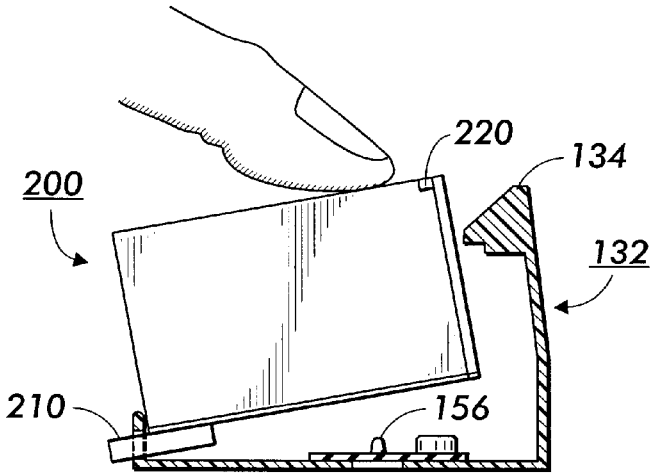
FIG. 9 is a side view of the ink tank support structure and an ink tank being partially inserted into the ink tank support structure by a user's finger.
Figure 10:
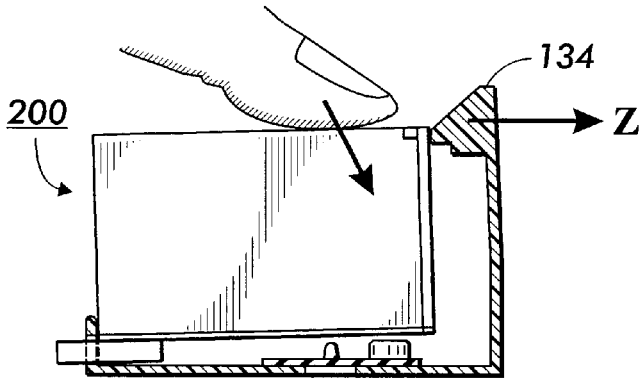
FIG. 10 is a side view of the ink tank support structure and the ink tank of FIG. 9 being more fully inserted into the ink tank support structure by a user's finger.
Figure 11:
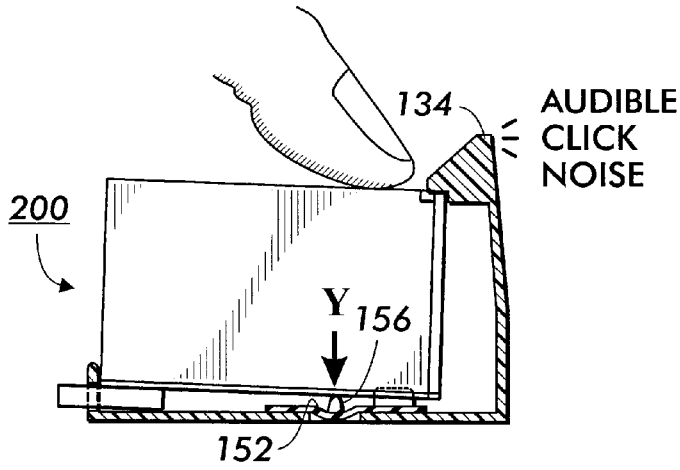
FIG. 11 is a side view of the ink tank support structure and the ink tank of FIG. 9 being fully inserted into the ink tank support structure by a user's finger.
Figure 12:
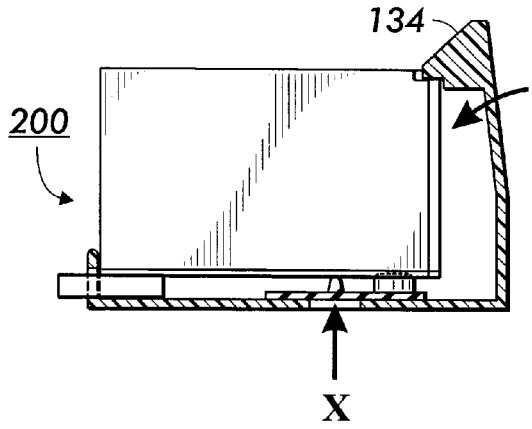
FIG. 12 is a side view of the ink tank support structure and the ink tank of FIG. 9 retained in a proper position and orientation in the ink tank support structure.
Figure 13:
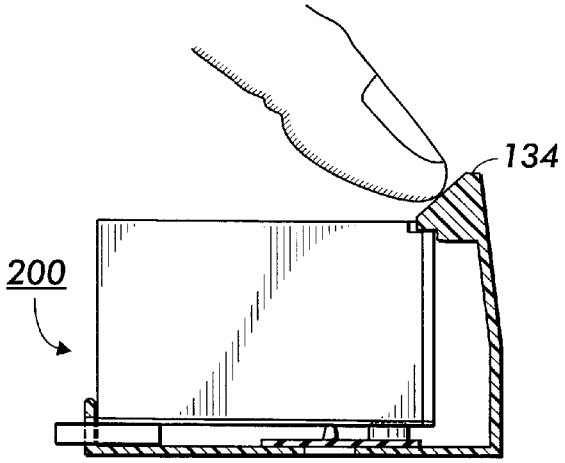
FIG. 13 is a side view of the ink tank support structure and the ink tank of FIG. 9 immediately prior to being released from the ink tank support structure by a user's finger.
Figure 14:
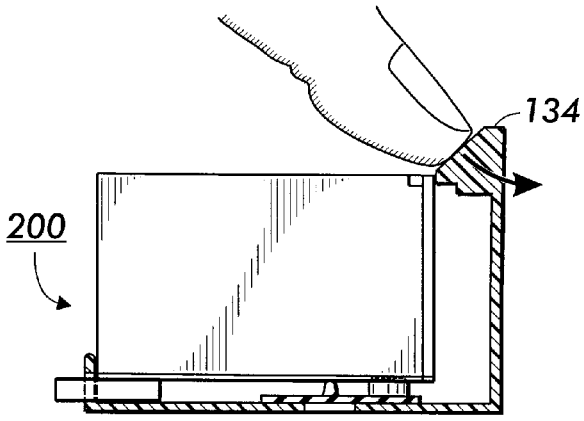
FIG. 14 is a side view of the ink tank support structure and the ink tank of FIG. 9 showing a user's finger applying force to the ink tank support structure release mechanism.
Figure 15:
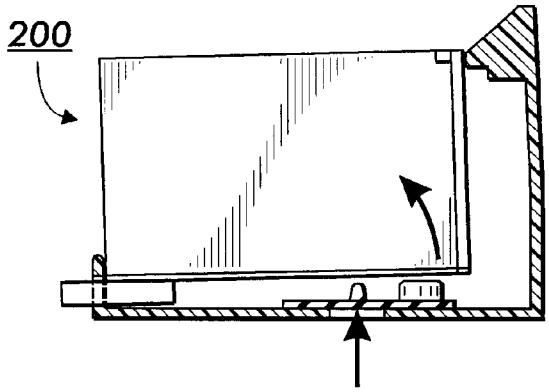
FIG. 15 is a side view of the ink tank support structure and the ink tank of FIG. 9 being biased upward and away from the ink tank support structure after its release from the release mechanism.
Figure 16:
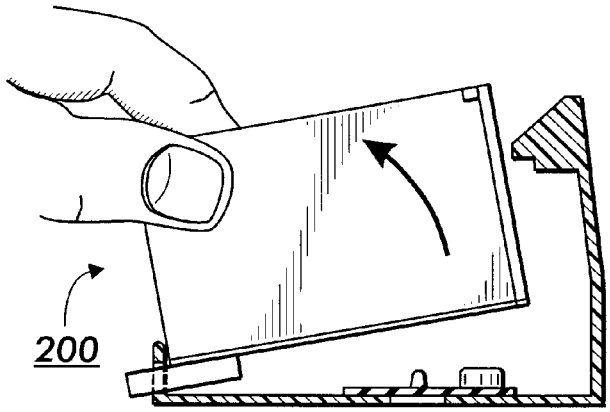
FIG. 16 is a side view of an ink tank released from its securing mechanism being lifted from the ink tank support structure.
Figure 17:
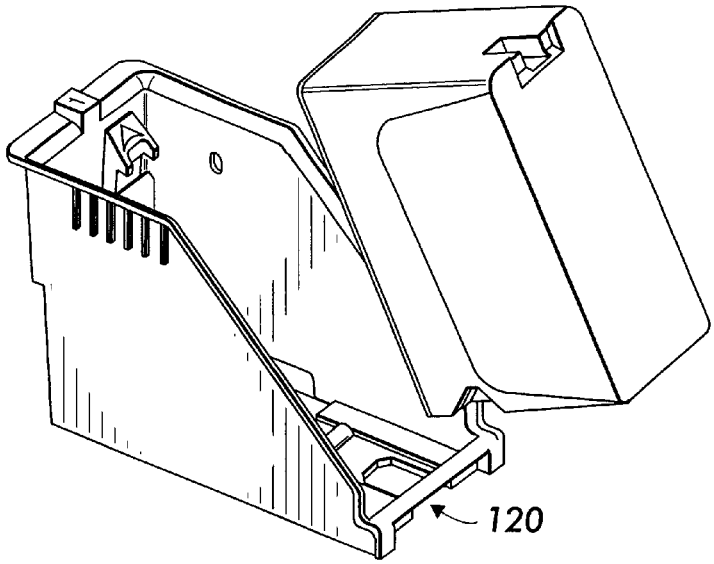
FIG. 17 is a perspective view of a second exemplary embodiment of the ink tank support structure and an ink tank according to this invention prior to installation.
Figure 18:
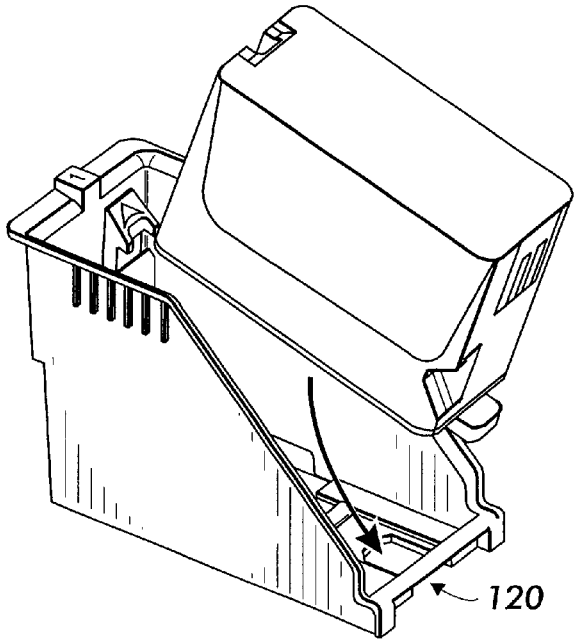
FIG. 18 is a perspective view of the ink tank support structure and the ink tank of FIG. 17 just prior to installation.
Figure 19:
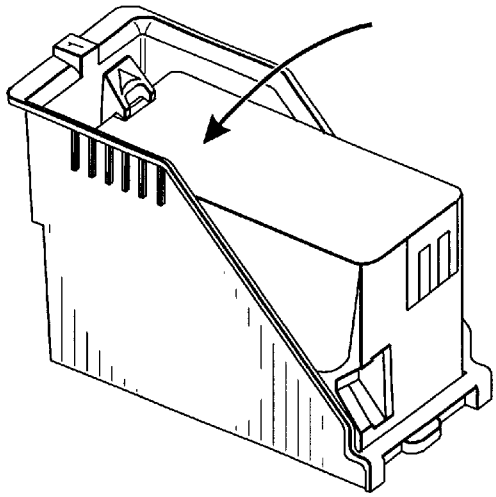
FIG. 19 is a perspective view of the ink tank support structure and the ink tank of FIG. 17 after installation.

As illustrated in FIG. 9, the ink tank extension locator foot 210 is inserted into one of the one or more ink tank clearance slots 120 and the ink tank 200 is pressed down toward the first surface 102 of the ink tank support structure 100. A shown in FIG. 10, pressure is exerted on the ink tank 200 and the retainer portion 134 and retaining release portion 136 of the latch mechanism 132. This pushes the retainer portion 134 and the retaining release portion 136 away from the ink tank, in the direction of arrow Z. As shown in FIG. 11, pressure exerted in a downward motion in the direction of arrow Y compresses the low compression force seal 152 and one or more resilient members 156, and pushes the top of the ink tank 200 below the bottom edge of the retainer portion 134 of the latch mechanism 132. As a result, the retainer portion 134 snaps back over the ink tank 200 and engages the latch ramps 220. The downward force exerted against the ink tank 200 to position it properly is absorbed to a large extent by resilient member 156, instead of by relatively low force seal member 152. As shown in FIG. 12, the spring force applied by the one or more resilient members 156, which exert a force in the direction shown by arrow X against the latch mechanism 132, securely positions the ink tank 200 in a proper position in the ink tank support structure 100.

The ink tank 200 is properly positioned in the ink tank support structure 100 using a latching "hook and rock" motion. As shown in FIGS. 9–12, and 17–19, this method comprises positioning the ink tank 200 above the ink tank support structure 100. The ink tank extension foot 210 is then inserted into the clearance slots 120 of the ink tank support structure 100, as shown in FIG. 4. As shown in FIGS. 9–12, the ink tank 200 is rocked or pivoted back into the ink tank support structure 100, so that the one or more ink tank ramps 220 engage the retaining portion 134 of the latch mechanism 132 and are latched by the latch mechanism 132. The retainer bar 122 retains the extension locator foot 210 while the ink tank 200 is being inserted and when the ink tank 200 is fully inserted into the ink tank support structure 100. In various exemplary embodiments, this also generates an audible "clicking" sound, illustrated in FIG. 11, to audibly notify a user that the latch mechanism 132 has securely secured the ink tank 200 in the ink tank support structure 100.

To release the ink tank 200 from the ink tank support structure 100, force is applied against the retaining release portion 136 of the latch mechanism 132. As shown in FIG. 8, the retaining release/top portion 136 of the latch mechanism 132 contains the indicia 137, illustratively in the form of an arrow, that indicates where and in what direction this force is to be applied. The spring force exerted by the one or more resilient members 156 and the relatively small force exerted by the low compression force seal 152 urge the ink tank 200 up and out of the operative position for the ink tank 200 when the retainer portion 134 is disengaged from the one or more ink tank latch ramps 220 upon applying this force to the retaining release portion 136. These forces applied by the resilient member 156 and the low compression force seal 152 also urge the ink tank 200 into a position in which the ink tank 200 is easier for a user to grasp to remove the ink tank 200 from the ink tank support structure 100.

Figure 20:
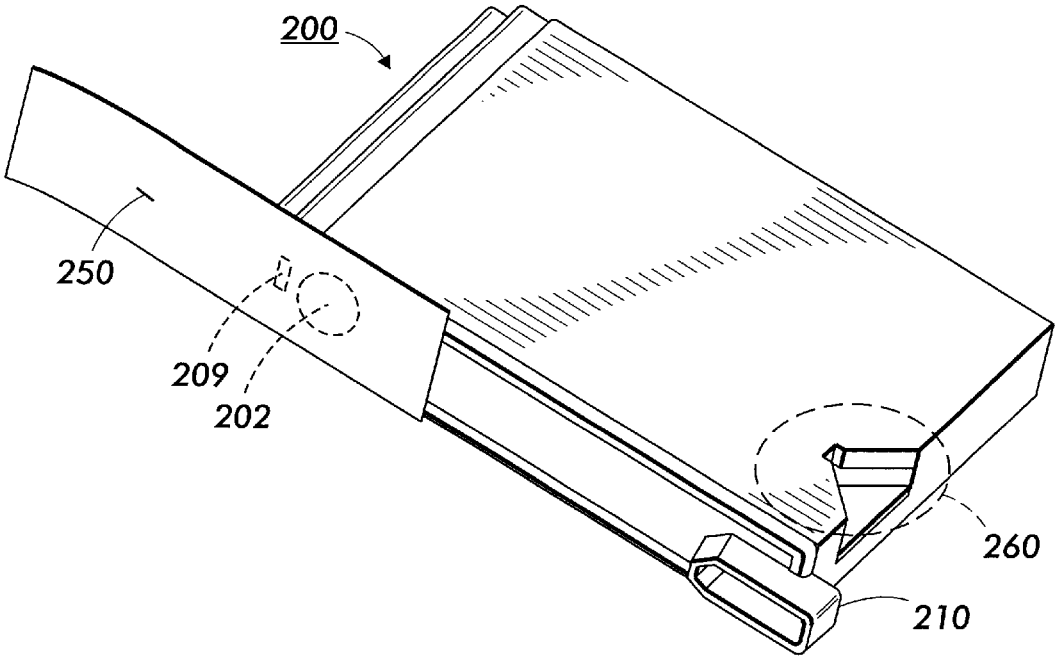
FIG. 20 is a bottom view of one exemplary embodiment of the ink tank of FIGS. 3–5.

FIGS. 13–16 show a second exemplary embodiment of ink tank 200 and ink tank support structure 100 in various stages of proper installation, and in which the dimensions of the ink tank 200 and are relatively large with respect to the extension locator foot 210, as compared with the first exemplary embodiment of the ink tank 200 depicted in FIGS. 3–6. This exemplary embodiment also illustrates that alterations in ink tank 200 and ink tank support structure 100 dimensions and configurations are within the scope of this invention. FIGS. 6 and 20 show the first surface or face or cover of the ink tank 200 which contains the ink tank port hole 202, illustrating that the location of the ink tank port hole 202 in that first surface, face or cover 201 is offset from the longitudinal axis of the extension locator foot 210 located on the ink tank 200. This additionally illustrates that varying the location of a port hole 202 is within the scope of the invention. The same principle applies to the locations, sizes and shapes of other ink tank 200 features, including the vent holes and the extension locator foot 210.

FIG. 21 shows a cross-sectional view of the relatively low compression seal 152 which forms part if the integral seal and ejection mat 150. It also shows that resilient element 156 may be an integral part of the integral seal and election mat 150.

FIG. 22 shows one exemplary embodiment of the first and second exemplary embodiments of the ink tank 200, including the latch ramps 220, which are located at one end of the ink tank 200 and extend into a surface or face of the ink tank 200. FIG. 22 also shows an ink fill hole 206 and a vent tube opening 208 in the top of the ink tank 200. A vent tube 240 extends from the top to the bottom of the ink tank 200. The latch ramps 220 are configured so that the latch mechanism 132 will engage with the latch ramps 220 to properly secure the ink tank 200 in the ink tank support structure 100.

Figure 23:
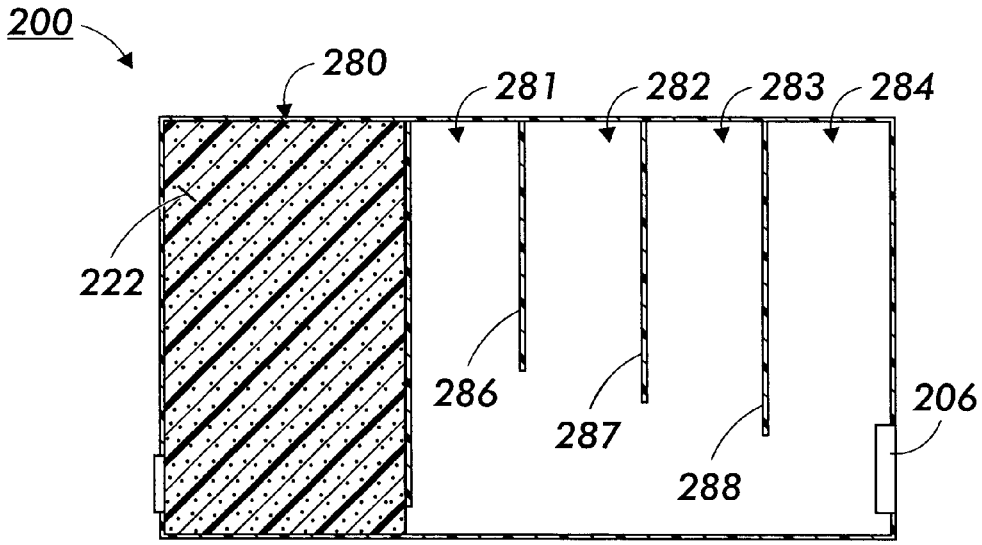
FIG. 23 is a cross-sectional side view of an ink tank with multiple ink chambers employing a staggered wall arrangement between ink tanks.

FIG. 23 shows a cross-sectional view of an ink tank 200 which uses staggered walls 286–288. In this illustrative embodiment, ink tank 200 has one capillary wick chamber 280 filled with a wicking material, such as, for example, a foam or sponge material 222, which draws ink from one or more ink chambers, illustratively, ink chambers 281, 282, 283 and 284. The number, size, shape and location within the ink tank 200 of the ink chambers 280–284 may vary. In operation, when ink is removed from the ink tank wick chamber 280, free ink from chamber 281 flows into ink chamber 280, saturating the wick material 222. Because the ink tank 200 is vented to atmosphere, as this happens, air flows into chamber 281. The amount of air drawn into ink chamber 281, which appears as an air bubble in the ink chamber 281 varies depending on the amount of ink withdrawn from the ink tank wick chamber 280, and ambient atmospheric conditions, including atmospheric temperature and pressure. Atmospheric pressure and temperature changes affect the size of the air bubble in the ink chamber 281. If, for example, the air bubble is increased in size due to such pressure and temperature changes, the larger air bubble may push ink from ink chamber 281 into the wick chamber 280 which may result in over saturation of the wick material and tend to cause leakage of ink out of the ink tank. The use of staggered height/depth ink chamber walls, shown as walls 286, 287 and 288 for purposes of illustration, tends to lessen any deleterious effect that such air bubbles may cause, including the aforementioned leakage problems. In operation, when ink is released from the ink tank 200 wick chamber 280, free ink from ink chamber 281 re-saturates the wick material 222 and an air bubble (not shown) is released into ink chamber 281. As ink is used, this process continues until the ink level in ink chamber 281 reaches the bottom of wall 286, which is a predetermined distance above the bottom of ink chamber 281. Ink then begins to flow from the adjacent ink chamber 282 into ink chamber 281, and that ink is replaced by air. This continued until the ink level in ink chamber 282 reaches the level of the bottom of wall 287. Ink then begins to flow from the adjacent ink chamber 283, and that ink is replaced by air. When the ink level in the last ink chamber 284 reaches the bottom of wall 288, an accurate determination of the ink level in the tank can be made. The staggered wall arrangement also acts as a baffle, reducing ink sloshing and foaming, thereby reducing the amount of bubbles formed in an ink tank. Bubbles caused by foaming of ink within the ink tank 200 tend to stick to the ink viewing mechanism 206, thereby deleteriously affecting ink level determination. Use of a staggered wall arrangement for ink tank chambers 280–284 reduces this deleterious effect. Although the staggered walls 286–288 are shown as being parallel to each other, they may be at various angles to each other depending on the location of the ink chambers 280–284 within the ink tank 200.

FIGS. 24–28 provide perspective views of ink tanks 200 showing internal construction variations that allow different ink amounts to be carried by the ink tanks 200. The amount of ink contained in an ink tank 200 determines the number of pages that can be printed using the ink from a specific ink tank 200 before that ink tank 200 needs to be refilled or another ink tank 200 installed. One advantage of these ink tank 200 constructions is that the external dimensions and features of the ink tanks 200 remain the same while providing for varying volumes of ink.

Figure 24:
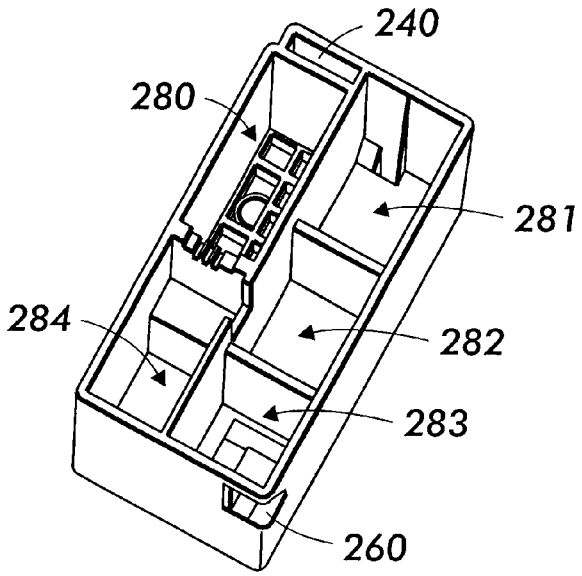
FIG. 24 is a perspective view of a partially assembled large capacity ink tank using multiple ink chambers.
Figure 25:
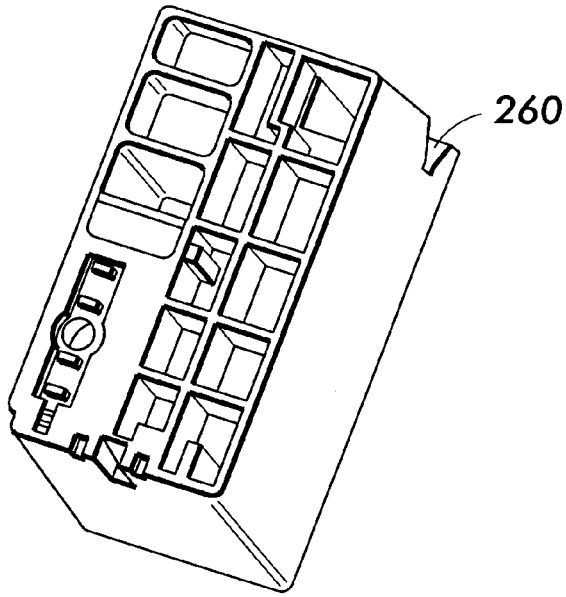
FIG. 25 is a perspective view of the ink tank of FIG. 24 inverted 180 degrees, showing another side of the ink chambers.

FIG. 24 shows the inside of a relatively large capacity ink tank 200 with its cover 201 removed. Ink tank 200 has a capillary chamber 280 in which foam 222 (not shown in this figure) is placed. Adjacent to capillary chamber 280 is a vent 240. Typically, capillary chamber 280 remains the same in terms of size and shape from one capacity ink tank 200 to another. This permits tank covers 201 and sealing devices 250 to remain relatively uniform for different capacity ink tanks 200. This allows basically the same chamber 280 that contains the capillary member 222 to have relatively the same geometry from ink tank 200 to ink tank 200. This allows the same capillary member 222 to be used in ink tanks 200 having different ink capacities. The size of the chamber(s) that hold the ink is modified by changing the configuration of the tool used to mold the ink tank 200. The size of the ink chambers 281–284 may be expanded or contracted by moving the walls 286–288 that bound the ink chamber 281–284 volume, or moving the height of the ink chambers 281–284, for example. The volume of ink chambers 281–284 is modified to maintain the height of the ink at or below the height of the capillary chamber 222 when the ink tank 200 is properly installed in an ink tank support structure 100. FIG. 25 shows the ink tank 200 depicted in FIG. 24 reoriented or flipped 180 degrees from the orientation of ink tank 200 in FIG. 24.

Figure 26:
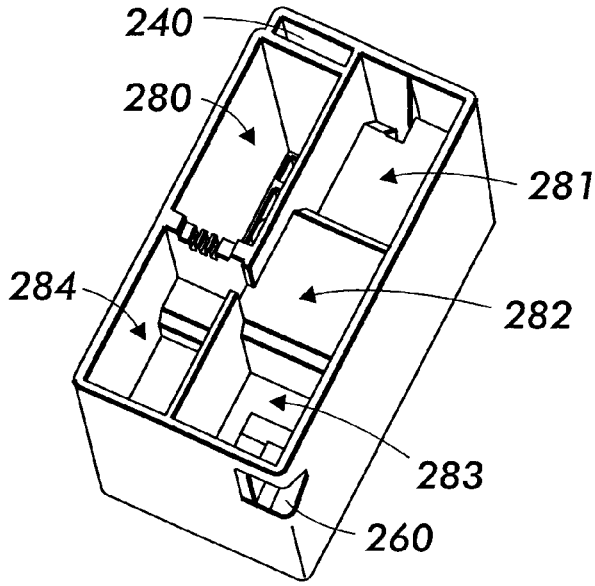
FIG. 26 is a perspective view of a partially assembled normal capacity ink tank using multiple ink chambers.
Figure 27:
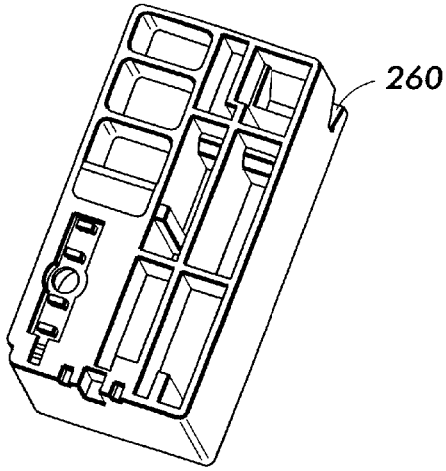
FIG. 27 is a perspective view of the ink tank of FIG. 26 inverted 180 degrees, showing another side of the ink chambers.

FIG. 26 shows the inside of a standard capacity ink tank 200. An inspection of FIG. 26 reveals that the capillary chamber 280 has the same size and shape as capillary chamber 280 in FIG. 24, but the size of the ink chambers 281–284 of ink tank 200 depicted in FIG. 26 is smaller than shown in the large capacity ink tank 200 shown in FIG. 24. FIG. 27 shows the ink tank depicted in FIG. 26 reoriented or flipped 180 degrees from the orientation of ink tank 200 in FIG. 26. The indentations in the surface of the ink tank 200 shown in FIG. 27 are deeper and have a different shape than the indentations in the surface of ink tank 200 shown in FIG. 25.

Figure 28:
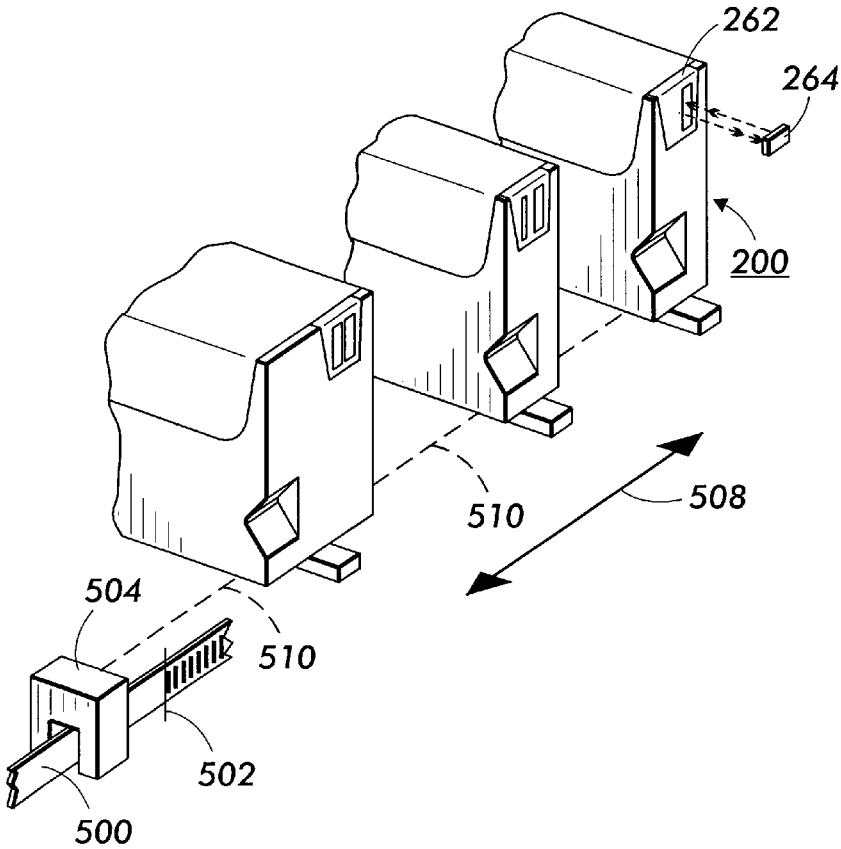
FIG. 28 is a schematic view of ink tanks with an indicator and indicator reader mechanism.

FIG. 28 shows an illustrative embodiment of another embodiment of this invention in which machine readable indicia 262 are provided on the ink tanks 200. An ink tank indicia sensor 264 that reads those indicia is also provided. The indicia 262 may provide information to, for example, identify the ink capacity of the ink tank 200, the type of ink in the cartridge, including ink color and/or whether the ink is dye based or pigment based, the brand of cartridge, etc. The type of ink used is sensed in order to be able to match machine performance with the ink properties. For example, if pigment based and dye based inks are mixed, they tend to coagulate and clog print heads and maintenance systems, seriously affecting performance and operability of the machine. It is important to distinguish between dye based inks and pigment based inks to optimize print quality, drop volume and print head reliability. Ink tanks 200 are moved along a track 508 relative to the ink tank sensor 264, illustratively by a mechanically movable carriage (not shown). Each ink tank 200 is associated with a specific location on the carriage. FIG. 28 shows a carriage position sensor 504 which senses a carriage home position mark 502 on a film 500 which moves with the carriage (not shown) and marks on the film which correspond with actual positions of the ink tanks 200 when the carriage is moved in the directions indicated by arrows 508 by a mechanical linkage shown by a dashed line 510, to determine the location of the carriage and, therefore, a specific ink tank 200 on that carriage relative to the position of the ink tank indicia sensor. This mechanism correlates the indicia detected by the sensor 264 to the specific ink tank 200 being detected by sensor 264.

This invention provides an ink tank and an ink tank support structure that are configured to substantially reduce the possibility that an ink tank will be improperly installed into the ink tank support structure, and which has an improved seal structure that reduces ink leakage and improper evaporation of fluid leaking from the ink tank despite repeated insertions into and removals of the ink tank from the ink tank structure. It also provides variable capacity ink tanks and ink tank chambers with staggered height walls, a system for detecting characteristics of the ink tanks, including their brands and their contents, and an improved primary ink tank vapor and liquid seal which may be integrally formed in an ink tank cover.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An ink tank comprising:

a cover;

an ink port; and an ink tank port wiper seal in the form of a non-separable hollow annular extension lip of the cover and dimensioned such that the lip extends into the inside of the ink tank beyond the inside surface of the cover when engaged by an ink tank manifold pipe.

2. The ink tank as in claim 1, where the wiper seal is made of a semi-rigid plastic material.

3. The ink tank of claim 2 wherein, when an ink manifold pipe is inserted into the ink tank through the ink tank port, the ink tank seal is dimensioned and located such that the ink tank seal forms a compression seal with the ink manifold pipe.

4. The ink tank of claim 3 wherein the manifold pipe that is insertable in the ink tank has a tapered portion.

5. The ink tank of claim 1, wherein the extension lip is an extra bit of the cover material.

6. The ink tank of claim 1, wherein the extension lip is a piece of flash of the cover material.

7. The ink tank of claim 1, wherein the extension lip has a thickness which is less than the thickness of the cover.

8. The ink tank of claim 1, wherein the extension tip does not extend below the portion the cover immediately adjust to the extension lip.

9. An ink tank comprising:

a cover;

an ink port; and an ink tank port wiper seal in the form of a hollow annulus integrally molded as an extension lip of the cover and dimensioned such that the lip extends into the inside of the ink tank beyond the inside surface of the cover when engaged by an ink tank manifold pipe.

* * * * *